US007971378B2

(12) United States Patent
Campoy Odena

(10) Patent No.: US 7,971,378 B2
(45) Date of Patent: Jul. 5, 2011

(54) ELECTRONIC ADVERTISING PANEL FOR PLAYING FIELDS

(75) Inventor: Sergio Campoy Odena, Barcelona (ES)

(73) Assignee: Odeco Electronica, S.A., Barcelona (ES)

( * ) Notice: Subject to any disclaimer, the term of this patent is extended or adjusted under 35 U.S.C. 154(b) by 108 days.

(21) Appl. No.: 11/994,139

(22) PCT Filed: Aug. 2, 2006

(86) PCT No.: PCT/ES2006/000457
§ 371 (c)(1),
(2), (4) Date: Dec. 28, 2007

(87) PCT Pub. No.: WO2007/017543
PCT Pub. Date: Feb. 15, 2007

(65) Prior Publication Data

US 2008/0163526 A1 Jul. 10, 2008

(30) Foreign Application Priority Data

Aug. 4, 2005 (ES) ..... 200501958

(51) Int. Cl.
*G09F 13/22* (2006.01)

(52) U.S. Cl. ..... 40/544; 40/605; 362/235

(58) Field of Classification Search ..... 40/571
See application file for complete search history.

(56) References Cited

U.S. PATENT DOCUMENTS

| | | | | |
|---|---|---|---|---|
| 3,748,455 | A * | 7/1973 | Welton | 362/97.1 |
| 4,254,453 | A * | 3/1981 | Mouyard et al. | 362/240 |
| 4,489,306 | A * | 12/1984 | Scolari | 340/473 |
| 4,703,219 | A | 10/1987 | Mesquida | |
| 4,742,432 | A * | 5/1988 | Thillays et al. | 361/783 |
| 5,040,868 | A * | 8/1991 | Waitl et al. | 385/33 |
| 5,321,417 | A * | 6/1994 | Voelzke et al. | 345/32 |
| 5,779,351 | A * | 7/1998 | Erickson et al. | 362/241 |
| 6,926,375 | B2 * | 8/2005 | Nagamine et al. | 312/111 |
| 2004/0107615 | A1 * | 6/2004 | Pare | 40/544 |
| 2004/0123501 | A1 * | 7/2004 | Safavi et al. | 40/452 |
| 2004/0175189 | A1 * | 9/2004 | Weber-Rabsilber et al. | 398/201 |
| 2006/0213098 | A1 * | 9/2006 | Chan et al. | 40/544 |

FOREIGN PATENT DOCUMENTS

| | | | |
|---|---|---|---|
| DE | 19623881 | A1 | 12/1997 |
| ES | 2036451 | B1 | 5/1993 |
| ES | 1044057 | U | 3/2000 |

* cited by examiner

*Primary Examiner* — Joanne Silbermann
*Assistant Examiner* — Kristina Staley
(74) *Attorney, Agent, or Firm* — Dennis G. LaPointe

(57) ABSTRACT

The invention relates to an electronic advertising panel for playing fields. The inventive panel is formed by modules consisting of a functional sandwich-type assembly comprising a metal plate (3), at least one polycarbonate sheet (4) and at least one PCB plate (5) which is equipped with LEDs (5.1). The components of the aforementioned assembly are joined using bolts (6) which are inserted into the metal plate (3) and which extend through the polycarbonate sheet(s) (4) and the PCB plate(s) (5). Said functional assembly is housed in a casing which is equipped with coupling means for joining modules and with support feet which can be rotated between a folded position and a use position.

1 Claim, 9 Drawing Sheets

ELECTRONIC ADVERTISING PANEL FOR PLAYING FIELDS

FIELD OF THE ART

The object of the present invention is an advertising panel of the type used in playing fields in sports stadiums, proposing an advertising panel of this type with functional and/or constructive features making it advantageous for its application.

STATE OF THE ART

Currently, displaying advertisements in sports stadiums is common due to their great power to draw people to them, these advertisements normally being placed on stationary panels at ground level around the playing field or court where the sports events are carried out.

Sports events can have great expectation at a national and international level, which values television retransmission, increasing the scope of the advertisements shown, given that they can be seen both by spectators that are located in the stadium itself where the sports event is being celebrated and by the audience watching the event on television.

To make the most of the space and the capacity of showing the greatest number of advertisements, dynamic advertising panels which are also placed at the ground level of the stadiums are also known.

However these types of dynamic panels, formed by an electronic luminous composition, generally have problems with the stadium's lighting, it being possible that the display of the advertisements can be affected by reflections, either due to solar effects during daytime events, or due to spotlights during nighttime events, the reflections even being able to bother the athletes participating in the events.

This type of conventional panels also have visors for the contrast of the luminous exhibits and the protection of the electronic luminous elements, which visors involve a hazard for the safety of the participants in events celebrated in stadiums because of the incidence of cuts and injuries that said visors can cause upon the impact against them.

Object of the Invention

According to the present invention an electronic advertising panel intended for sports stadiums is proposed, which has been provided with functional and/or constructive features that allow displaying advertisements with or without movement, eliminating the problem of reflections that conventional electronic panels have.

This advertising panel object of the invention is formed by a series of modules that are joined to one another, each of which consists of a metal plate, a polycarbonate sheet and a printed circuit board provided with luminous LEDs, said component elements being joined to one another by means of the attachment with conventional elements, for example with bolts, washers and nuts, forming a compact sandwich-type assembly which is covered with a metal casing.

The covering metal casing incorporates at the sides coupling means for the joining coupling of modules to one another, whereas at the lower part support feet are incorporated which can be rotated between a folded position for transporting and an unfolded position for the support on the ground in the application installation.

The structural assembly of each of the mentioned modules forming the panel includes the electronic image reproduction functional assembly housed in an airtight assembly, with an arrangement in the formation of said functional assembly preventing ambient light reflections, whereby the visibility of the exhibits of the panel in its application function is favored.

In this sense the luminous LEDs of the functional assembly are housed in bubbles determining the polycarbonate sheet, therefore said LEDs are perfectly protected and in an arrangement favoring the contrast of the luminosity that they emit, such that the arrangement of visors is not necessary, the hazards involved with such visors being prevented.

At the rear part of their structure, the modules can also determine housings for auxiliary elements of the functional activity, such as electric batteries, connection strips etc., forming an integrated assembly that is easy to transport, install and maintain.

The electric power supply of the functional assembly is carried out with direct low voltage current, for example by means of 12 volt batteries, whereby any risk of injuring people though electrocution is also prevented.

Due to the above, said panel object of the invention has advantageous features providing it with its own identity and a preferred character with regard to conventional panels of the same application.

DETAILED DESCRIPTION OF THE INVENTION

Figure 1:
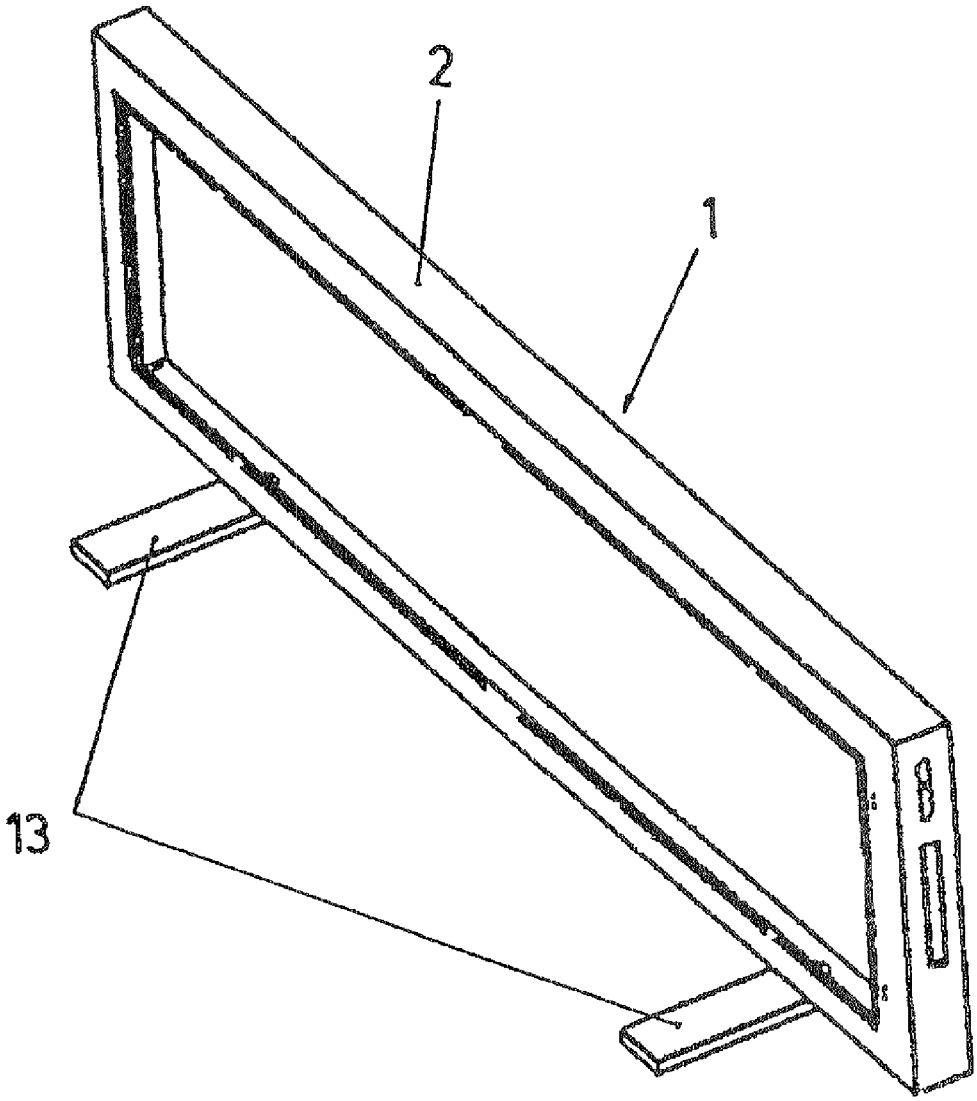
FIG. 1 shows a front perspective view of a module of the advertising panel object of the invention.
Figure 2:
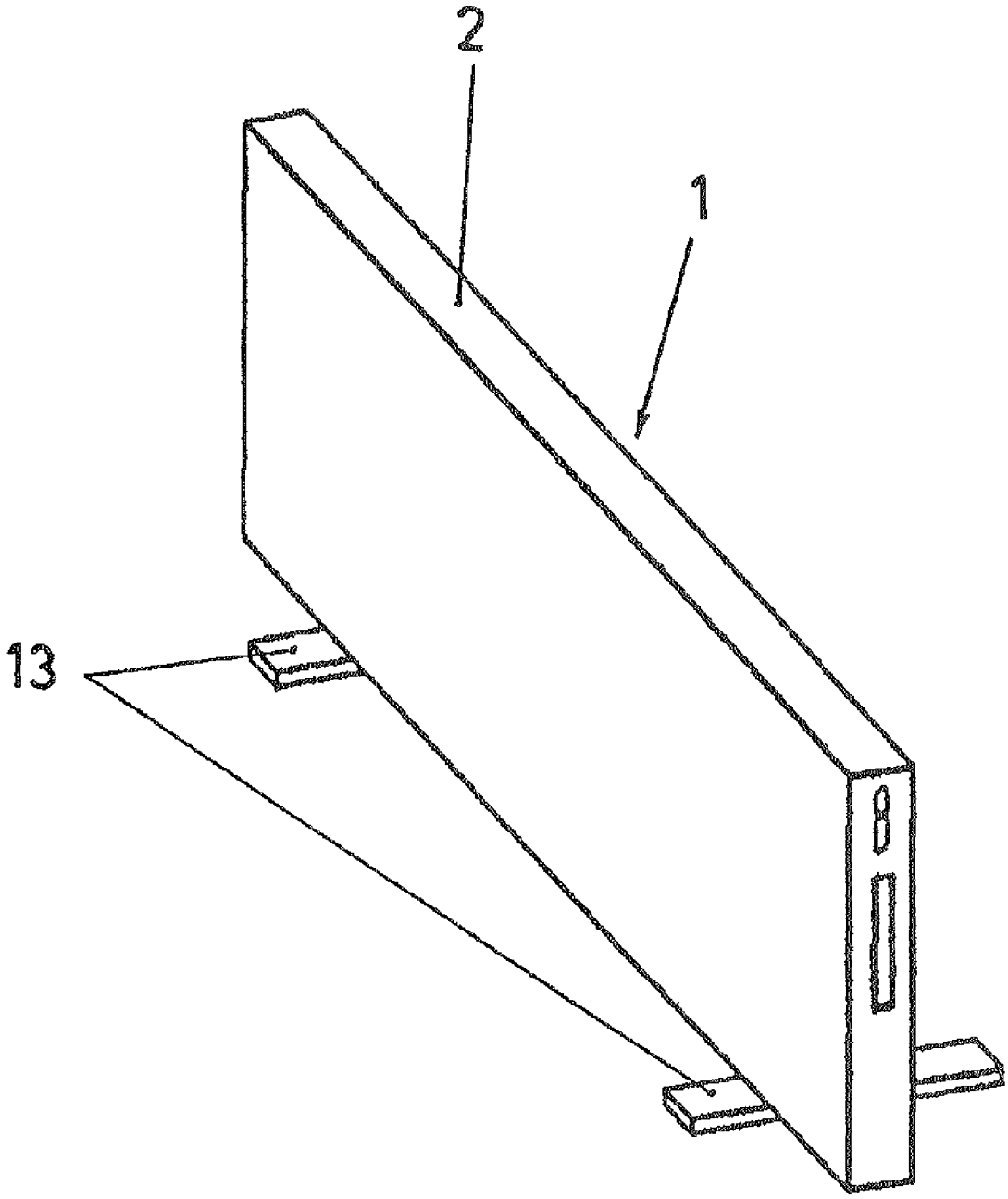
FIG. 2 shows a rear perspective view of the module of the previous figure.
Figure 3:
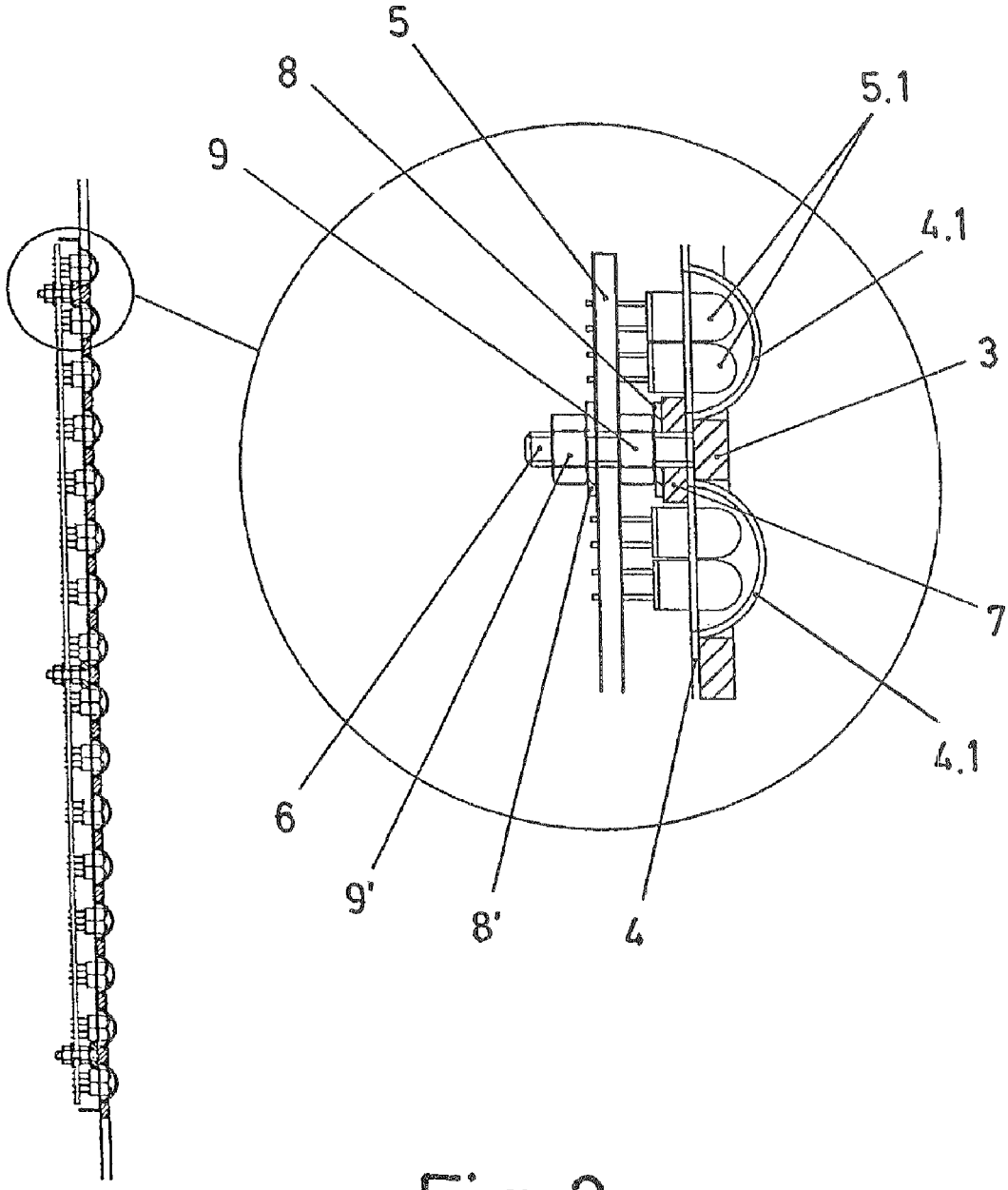
FIG. 3 shows a sectional side view of the functional assembly of a module of the proposed panel, with an enlarged detail of a part of said assembly, according to a certain embodiment.
Figure 4:
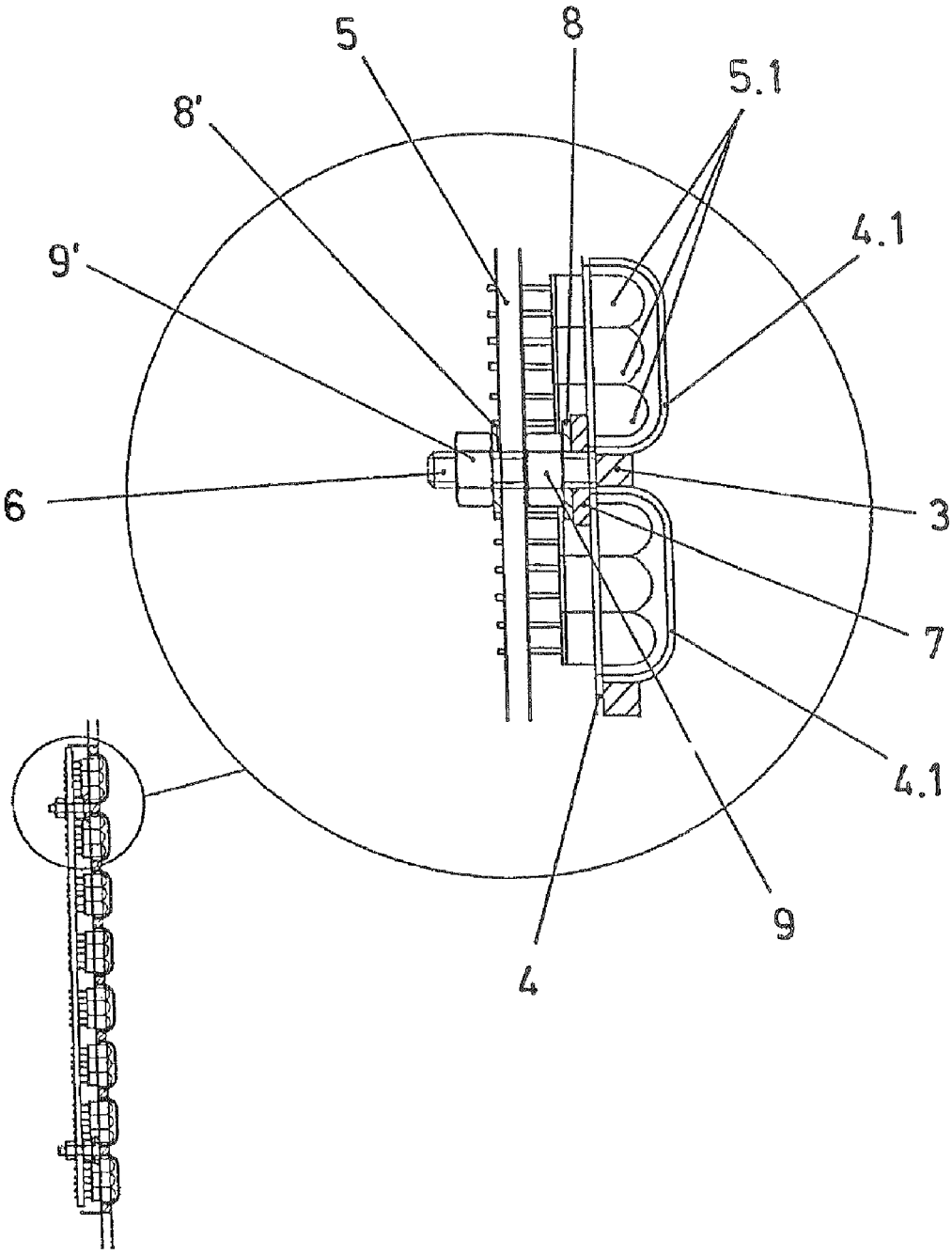
FIG. 4 shows a sectional side view of the functional assembly of a module of the proposed panel, with an enlarged detail, according to another embodiment.
Figure 6:
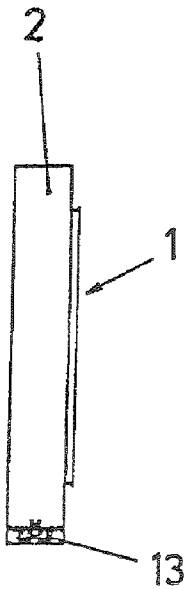
FIG. 6 shows a corresponding side view with regard to the previous figure.
Figure 5:
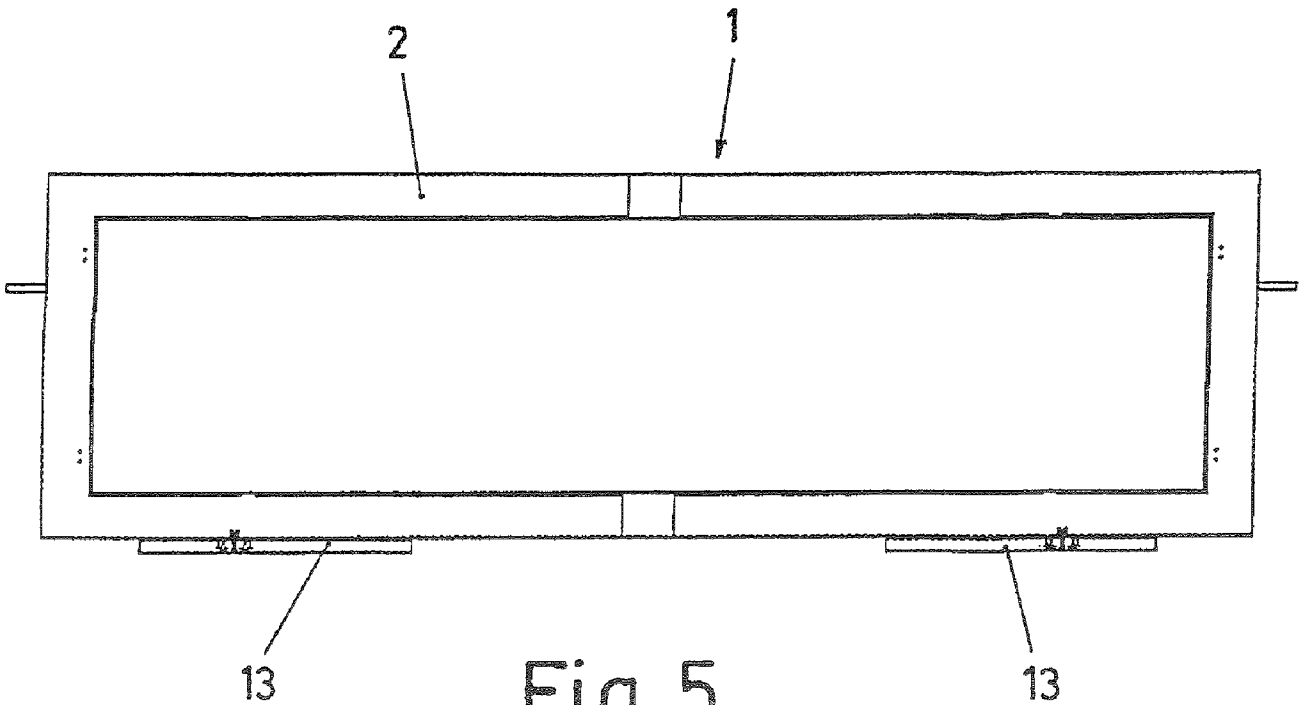
FIG. 5 shows a front view of a module of the proposed panel, with the support feet in a folded position.
Figure 7:
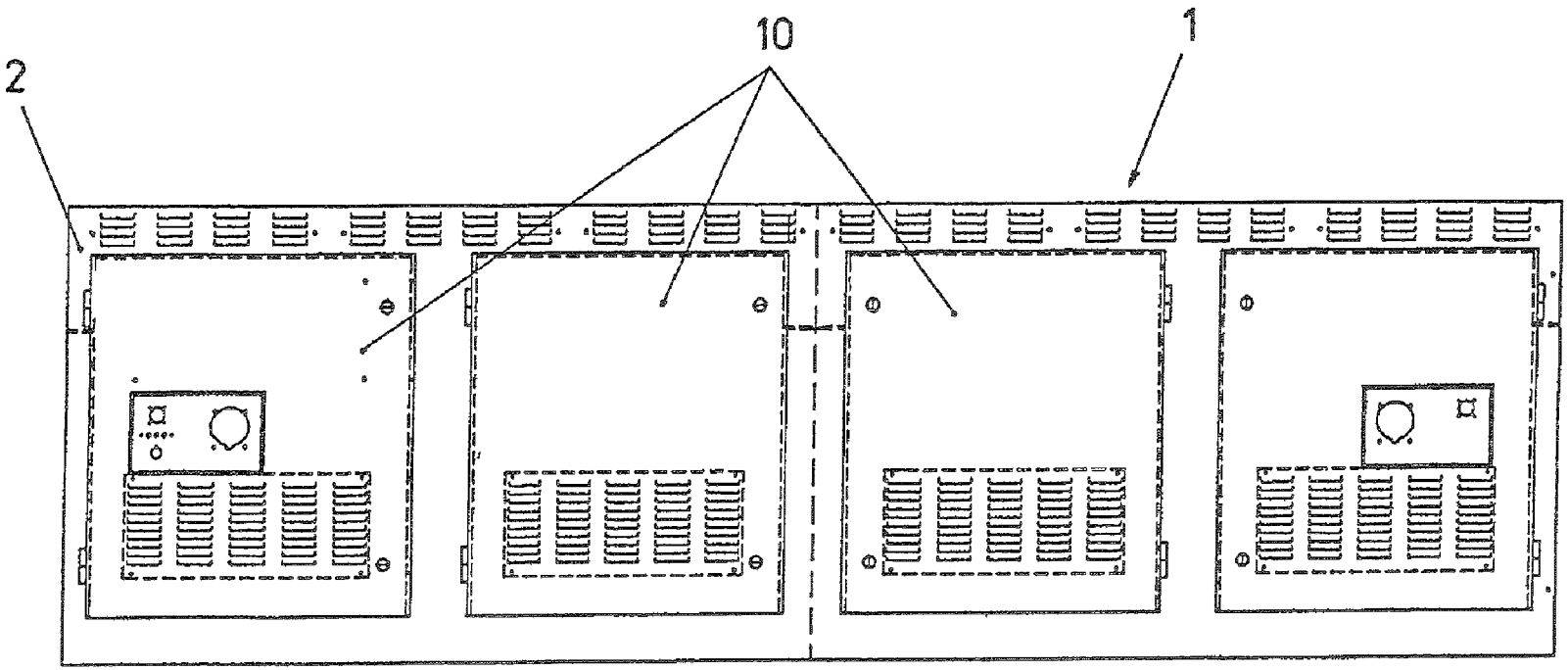
FIG. 7 shows a rear view of a module provided with access doors.
Figure 8:
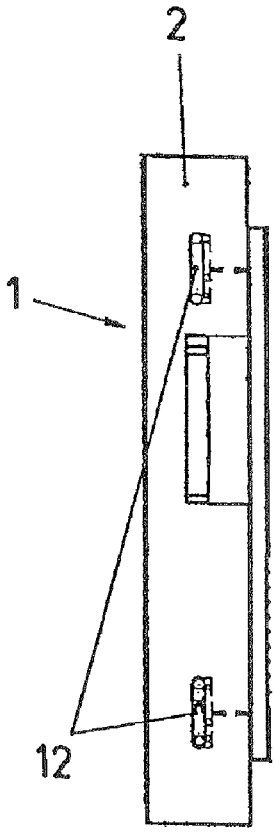
FIGS. 8 and 9 respectively show a side view and a rear view of the ends of a module with coupling elements for joining modules to one another.
Figure 9:
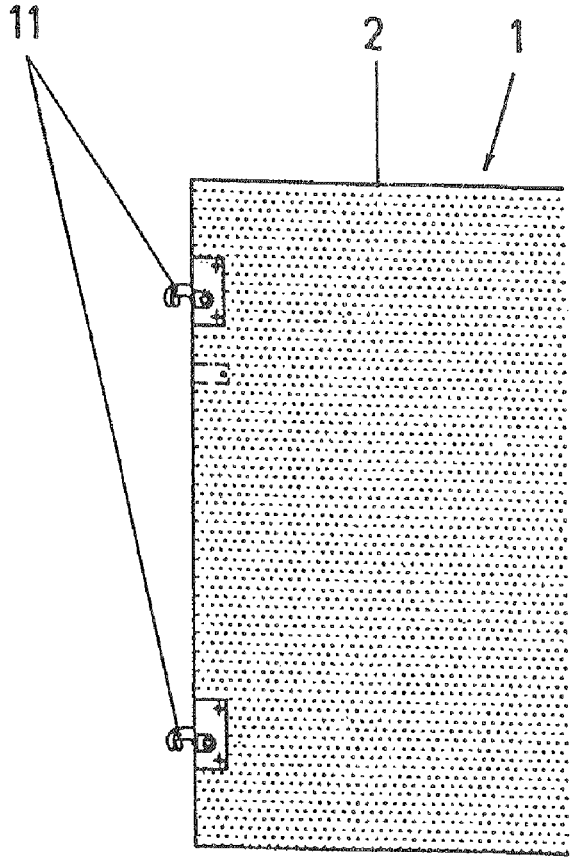
Figure 10:
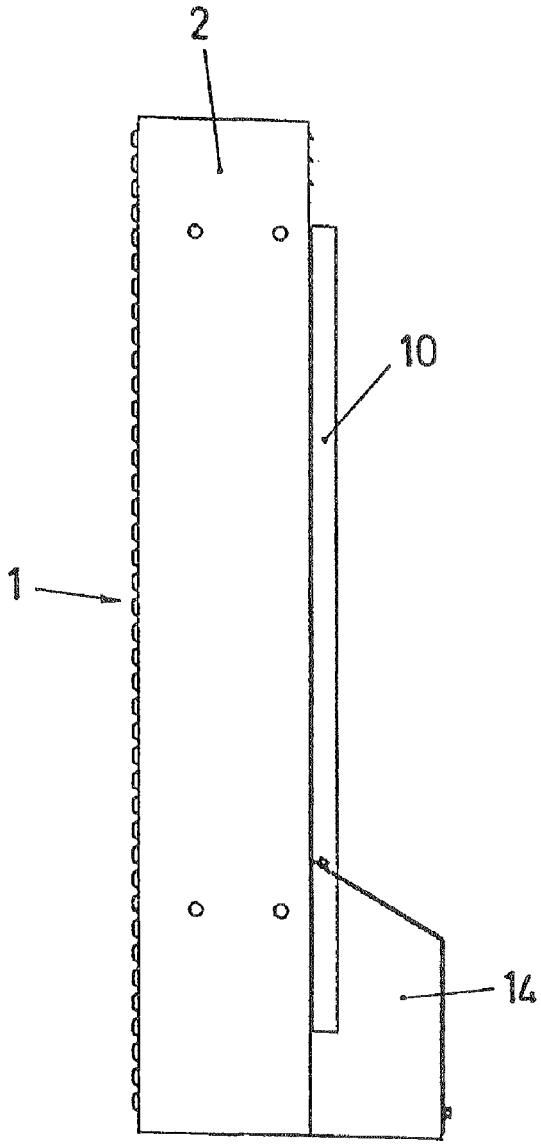
FIG. 10 shows a side view of a module provided with a lower enlargement at the rear part for housing component elements.
Figure 11:
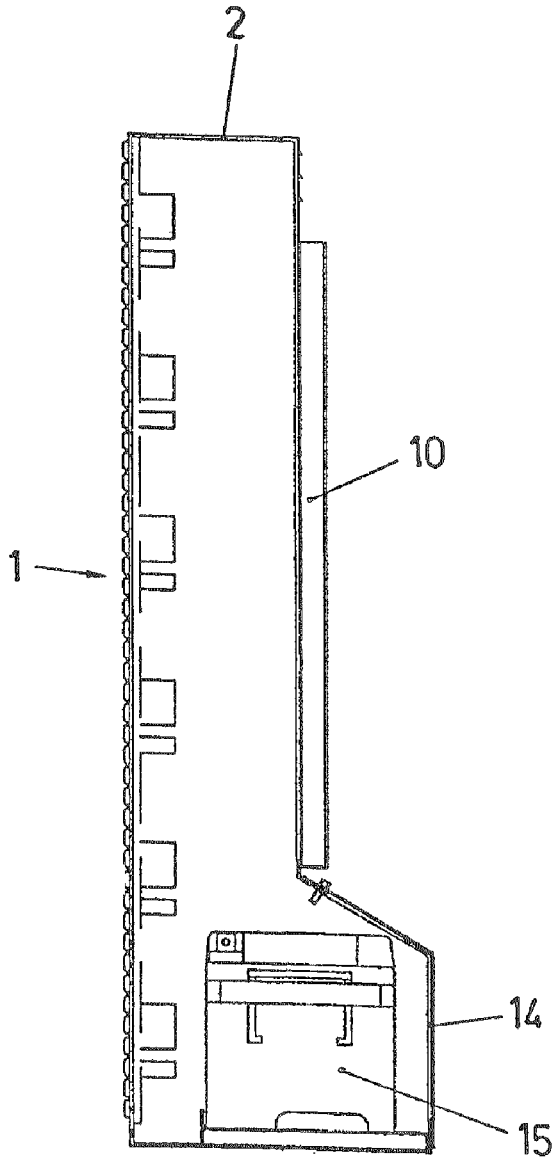
FIG. 11 shows a sectional side view of the module of the previous figure.
Figure 12:
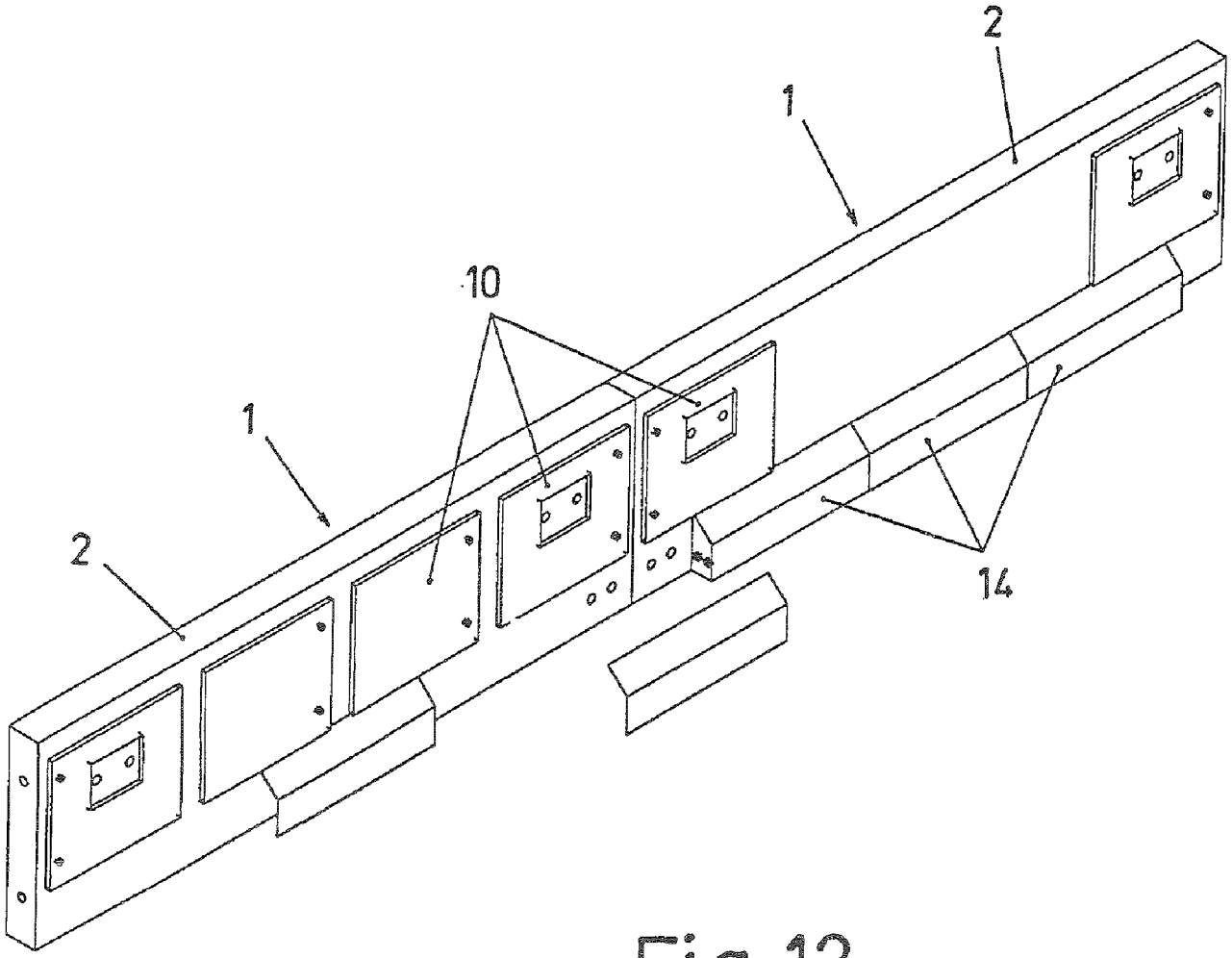
FIG. 12 shows a rear perspective view of two coupled modules such as the previous one.

The object of the invention relates to an electronic advertising panel of the type arranged in playing fields, proposing an embodiment with constructive features making said panel functionally advantageous for its application.

The proposed panel is made up of modules (1) that are consecutively joined to form assemblies of the desired extension, each module (1) comprising a metal casing (2) and a functional assembly integrating luminous image forming electronics.

The integrated functional assembly in each module (1) consists of a sandwich-type packet made up of a metal plate (3), at least one polycarbonate sheet (4) and at least one PCB plate (5) equipped with luminous LEDs (5.1), which are joined to one another by means of an anchor formed by bolts (6), rubber gaskets (7), washers (8) and nuts (9), the mentioned functional assembly being included housed in the casing (2).

The casing (2) determines at the front part a window through which the front of the functional assembly is visible, whereas the rear part can be provided with access doors (10) for accessing the component elements of the electronic installation of said functional assembly.

At the end sides, the casing (2) determines hooks for joining consecutive modules (1), such that at one of the ends said hooks are made up of hook-shaped pins (11), whereas at the other end reciprocal grooves (12) are defined in which the pins (11) of a consecutive module (1) can be fitted and coupled, a continuous panel composition in the desired extension can thus be formed by means of consecutive modules (1).

At the lower part, each module (1) incorporates feet (13) which are joined to the casing (2) in an assembly allowing the rotation of such feet, such that said feet (13) can be placed in a folded position for transporting the module (1) and in an unfolded position for the support on the ground, allowing the advertising panel to be installed without needing accessory attaching elements.

The metal plate (3) of the functional assembly determines a plurality of openings in correspondence with bubbles (4.1) of the polycarbonate sheets (4), said bubbles (4.1) being able to have a spherical cap shape or an elongated cap shape in order to house groups of two or three LEDs (5.1) of the PCB plates (5). In said conditions, in correspondence with each metal plate (3), multiple polycarbonate plates (4) can be incorporated, for example 30 or 60 polycarbonate plates (4) which are joined to one another with silicone.

With this arrangement, the bubbles (4.1) determine a covering assuring the protection of the LEDs (5.1), forming at the same time a light diffusion thereof that favors contrast, thus preventing the need to incorporate visors such as those used in conventional installations.

According to a particular constructive embodiment, the component elements of the functional assembly of the module (1) are joined by means of bolts (6) inserted into the metal plate (3), which bolts extend through the polycarbonate sheet (4), a rubber gasket (7), a washer (8) and a nut (9) being incorporated on such bolts at the rear part, while the PCB plate (5) is placed behind, the bolts (6) also passing through it, and another attachment with a corresponding washer (8') and a respective nut is formed behind.

The functional assembly thus formed is housed in the metal casing (2) determining an airtight housing in which humidity cannot be introduced, whereas said casing (2) can subsequently determine enlargements (14) for housing accessory elements (15) used for the functional activity, such as auxiliary batteries or the like, the electric power supply of the functional assembly being provided with direct low voltage current, for example by means of 12 volt batteries, risks of electrocution accidents thus being prevented.

What is claimed is:

1. An electronic advertising panel for playing fields, intended for displaying dynamic advertisements in sports stadiums, comprising a composition by modules to form the desired extension, wherein each composition module (1) of the panel comprising a metal casing (2) having at ends of said metal casing (2) reciprocating coupling means (11,12) for joining consecutive modules (1), each composition module (1) further including a functional assembly housed in said metal casing (2) formed by a sandwich-type packet formed by a metal plate (3), at least one polycarbonate sheet (4) and at least one PCB plate (5) provided with LEDs (5.1), wherein one of the ends of the metal casing (2) of each module (1) incorporates hook-shaped pins (11), and at the other end of said metal casing (2) are mating grooves (12) configured for coupling engagement with hook-shaped pins (11) of a consecutive module (1), the metal casing (2) further comprises doors (10) located on a back portion of said metal casing (2) for accessing the functional assembly and for housing accessory elements (15) for a functional activity, the metal plate (3) of the functional assembly of modules (1) comprises openings which correspond with bubble-shaped formations (4.1) of the polycarbonate sheet (4) wherein groups of two or three LEDs (5.1) of the PCB plate (5) are housed in said formations (4.1), wherein said groups of two or three LEDs (5.1) are protected and having a light diffusion arrangement that favors contrast without the need for visors, said bubble-shaped formations (4.1) having an elongated cap shape formed to house multiple LEDs (5.1) therein in groups of said two or three LEDs (5.1) of the PCB plate (5), said bubble-shaped formations (4.1) defining a covering assuring protection of the two or three LEDs (5.1) which are configured for favoring a contrast of a luminosity that said two or three LEDs (5.1) emit thereby preventing the need to incorporate said visors, the bubble-shaped formations (4.1) further being configured to allow the two or three LEDs (5.1) to project slightly from the metal plate (3) thereby improving a transmission angle with respect to said polycarbonate sheet (4), in correspondence with each metal plate (3) of the functional assembly of modules (1), multiple polycarbonate sheets (4) are incorporated and joined together with silicone, whereas in relation to the polycarbonate sheets (4), multiple PCB plates (5) are arranged and attached to the assembly with anchoring means on the metal plate (3), in an inner part of each module (1) the corresponding metal casing (2) incorporates feet (13) in said metal casing (2) which are rotatable between a folded position for transporting and an unfolded position for supporting the module (1) in its use arrangement, and the component elements of the functional assembly in the modules (1) are joined by means of bolts (6) inserted into the metal plate (3) extending through the polycarbonate sheets (4) and the corresponding PCB plates (5), a rubber gasket (7), a washer (8) and a nut (9) being incorporated on each bolt (6), attached to the polycarbonate sheets (4) on the metal plate (3), whereas behind the PCB plates (5) another washer (8') and another nut (9') are incorporated attaching said PCB plates (5).

* * * * *